US011236900B2

(12) United States Patent
Buhl

(10) Patent No.: US 11,236,900 B2
(45) Date of Patent: Feb. 1, 2022

(54) TORCH

(71) Applicant: Ledlenser GmbH & Co. KG, Solingen (DE)

(72) Inventor: Erich Buhl, Solingen (DE)

(73) Assignee: LEDLENSER GMBH & CO. KG, Solingen (DE)

( * ) Notice: Subject to any disclaimer, the term of this patent is extended or adjusted under 35 U.S.C. 154(b) by 0 days.

(21) Appl. No.: 16/767,430

(22) PCT Filed: Nov. 14, 2018

(86) PCT No.: PCT/DE2018/100925
§ 371 (c)(1),
(2) Date: May 27, 2020

(87) PCT Pub. No.: WO2019/105503
PCT Pub. Date: Jun. 6, 2019

(65) Prior Publication Data

US 2020/0300453 A1 Sep. 24, 2020

(30) Foreign Application Priority Data

Dec. 1, 2017 (DE) ..... 10 2017 128 583.0

(51) Int. Cl.

| | |
|---|---|
| ***F21V 31/00*** | (2006.01) |
| ***F21L 4/00*** | (2006.01) |
| ***F21V 14/06*** | (2006.01) |
| ***F21V 19/00*** | (2006.01) |
| *F21Y 115/10* | (2016.01) |

(52) U.S. Cl.
CPC ..... *F21V 31/005* (2013.01); *F21L 4/005* (2013.01); *F21V 14/065* (2013.01); *F21V 19/003* (2013.01); *F21Y 2115/10* (2016.08)

(58) Field of Classification Search
CPC ..... F21V 31/00–005; F21V 14/065; F21L 4/00–085
See application file for complete search history.

(56) References Cited

U.S. PATENT DOCUMENTS 8,833,960 B2 9/2014 Opolka
2006/0256563 A1* 11/2006 Uke ..... G03B 15/06 362/335
2010/0002422 A1* 1/2010 Ho ..... F21V 31/005 362/187

(Continued)

FOREIGN PATENT DOCUMENTS

DE 20 2016 101 541 U1 7/2016
EP 2596279 B1 8/2016
KR 20120096245 A * 8/2012

OTHER PUBLICATIONS

International Search Report and Written Opinion for Application No. PCT/DE2018/100925 dated Feb. 11, 2019 .

*Primary Examiner* — Mariceli Santiago
(74) *Attorney, Agent, or Firm* — Alston & Bird LLP

(57) ABSTRACT

The invention relates to a torch having a housing in which at least one LED secured to a carrier element, and a lens system, are arranged and can be displaced relative to one another in order to focus the cone of light that is emitted. According to the invention, a seal consisting of a membrane (14) closes the space (23) between the LED (11) and the lens system (13) in a watertight and dust-proof manner.

18 Claims, 6 Drawing Sheets

(56) References Cited

U.S. PATENT DOCUMENTS

2010/0219775 A1* 9/2010 Maglica ..... F21L 4/045
315/362
2011/0182059 A1* 7/2011 Liu ..... F21V 31/005
362/158

* cited by examiner

TORCH

CROSS-REFERENCE TO RELATED APPLICATIONS

This application is National Phase Entry of PCT Application Serial No. PCT/DE2018/100925 filed on Nov. 14, 2018, published as PCT Publication No. WO2019/105503, which claims priority to German Patent Application Serial No. 10 2017 128 583.0 filed on Dec. 1, 2017, the contents of each of which are hereby incorporated by reference in their entirety.

FIELD OF THE INVENTION

The invention relates to a torch having a housing in which at least one LED attached to a support element and an optical attachment are arranged, which are displaceable relative to one another to focus the light cone that is radiated.

BACKGROUND

Such a torch is known from DE 20 2016 101 541 U1, for example.

Battery-operated torches are an indispensable aid for being able to provide light in the event of a power failure or in the absence of power connections. The light-emitting diode, which is now available with high luminosities, has replaced the light bulb that was previously used without exception. The particular advantages of the LED are a comparatively low power requirement, high impact and shock resistance and a much longer life compared with light bulbs. The small-volume LEDs permitted a compact design of torches in connection with high light intensities. The LEDs are preferably arranged on a support element in the form of a socket, which can be connected electrically via suitable contact points and power connections to the batteries arranged in a battery compartment via a switch.

To be able to modify the light cone radiated, the optical attachment consisting of a lens or lens system is displaceable relative to the light source, meaning the LED. A relatively large beam angle for wide illumination or a small light cone angle consisting virtually of parallel light, with which significant luminous ranges can be achieved, can be set by relative displacement along the longitudinal axis. In individual cases, a compact optical attachment is also combined with a reflector, with the LED displaceable along the longitudinal axis being arranged in the latter's focal point. A reflector of this kind is used substantially to reflect light radiated laterally in the direction of the optical attachment. High-power LEDs require cooling that is realized by means of a heat sink, which is connected to the LED support or is part of the support.

In EP 2 596 279 B1, a torch is described having a housing in which a battery cartridge is supported, which has a pressure switch at the end. A push button located in an end cap is operatively connected to the pressure switch. Arranged between this push button and the pressure switch is a sealing element in the form of a cap of elastic material, wherein the cap has an annular clamping surface as well as a protrusion projecting therefrom. This measure aims to achieve waterproofness of the torch. However, the torch depicted in the drawings of this publication evidently has no option for adjusting the light cone.

DE 20 2016 101 541 U1 describes a torch in which a magnetic element is provided in the housing that is displaceable along the longitudinal axis and is magnetically operatively connected directly or indirectly to a sliding sleeve, which consists at least partially of ferromagnetic material and has at least one magnetic element. The sliding sleeve is supported inside the housing and receives the optical attachment, so that displacement of the magnetic element causes displacement of the optical attachment and therefore focusing or defocusing of the light cone that is radiated.

BRIEF SUMMARY

Apart from the fact that the relative displacement of the optical attachment by means of magnets is only functionally reliable if and for as long as exact guidance of the parts to be displaced is guaranteed, no measures are provided either that prevent moisture and/or dust from being able to penetrate into the lamp head, especially into the intermediate space between the optical attachment and the LED or the LED support. The O-rings used in many torches as a seal in the lamp head or in the region of the end cap are not sufficient at any rate to achieve the desired impermeability to water and dust.

The object of the present invention is to remedy this shortcoming, and in particular to create a torch that is waterproof and dust-tight and is simply constructed without high technical complexity.

This object is achieved by the torch according to claim 1, which is characterized in that a seal consisting of a membrane closes the space between the LED and the optical attachment in a waterproof and dust-tight manner. Due to its elasticity, the membrane permits a displacement of the LED along the longitudinal axis relative to the optical attachment without this seal being exposed to friction forces such as occur in particular in the case of the O-rings used according to the prior art. The seal thus operates free of wear. Any type of fastening of the seal to the optical attachment and the LED support element can be chosen because this seal is subject to practically no wear during the life of the lamp and thus does not have to be exchanged.

The seal preferably consists of elastic material, namely silicone rubber or natural rubber with a thickness (wall thickness) of 0.5 mm to 0.7 mm, for example 0.6 mm.

In a particular embodiment of the invention, the seal is provided on the upper edge with a collar that is clamped between the optical attachment and the housing, preferably in a groove incorporated on the internal wall of the housing. The lower edge of the seal is connected in a first implementation variant to an annular body, let into the surface of which facing the inside of the seal is a groove, which forms a positive connection with a hook-shaped nose of the support element. In a second embodiment that can be used alternatively, the seal has an annular rib on its inner sheath that engages in a groove of the support element for the LED.

A connection of this kind at both ends ensures secure fixing and dust-tight and waterproof sealing of said interior space between the LED and the optical attachment.

The collar, the seal and the annular body preferably form an integral part.

Several possibilities exist for implementing the relative displacement of the optical attachment with respect to the LED. In the present case, the optical attachment is arranged in a longitudinally displaceable lamp head, whereas the LED or its support element is arranged stationary in the lamp housing. The displacement of the lamp head along the longitudinal axis can also be achieved by means of a threaded connection, in which a maximal thread pitch is selected to avoid strong torsion loads of the seal. Instead of a thread between the lamp head and the lamp housing, in another configuration of the invention a helical guide can be provided between the lamp head and the lamp housing, via which guide the lamp head with the optical attachment is supported in a longitudinally displaceable manner with respect the LED, which is arranged fixedly in the lamp housing.

According to another configuration, a multipart design of the support element is provided, which has the following parts:

- a circuit board supporting the LED with voltage connections,
- two clamping elements for fixing the circuit board on pins that are used for the voltage supply and project from
- a base plate fixed in a non-rotating manner in the lamp housing,
- a holder with holes to lead the pins through and
- a front cover element, which has a front opening for the LED and snap-in hooks, which protrude to the rear and engage in corresponding recesses of the holder, preferably forming a snap connection.

A solution is preferred in which the support of the LED is provided on its outer jacket with longitudinal ribs, which engage in grooves on the internal wall of the lamp head. Depending on the desired displacement path, several circumferential grooves are provided, which optionally receive at least one rib of the support. The support can thus be displaced relative to the head in the manner of a ratchet connection and fixed at equidistant intervals that are determined by the groove spacings. A configuration of this kind calls for elasticity of one of the two elements, preferably of the lamp head in the region of the inside configured with grooves.

BRIEF DESCRIPTION OF THE FIGURES

Other embodiments are explained on the basis of the drawings. These show.

DETAILED DESCRIPTION

Figure 1:
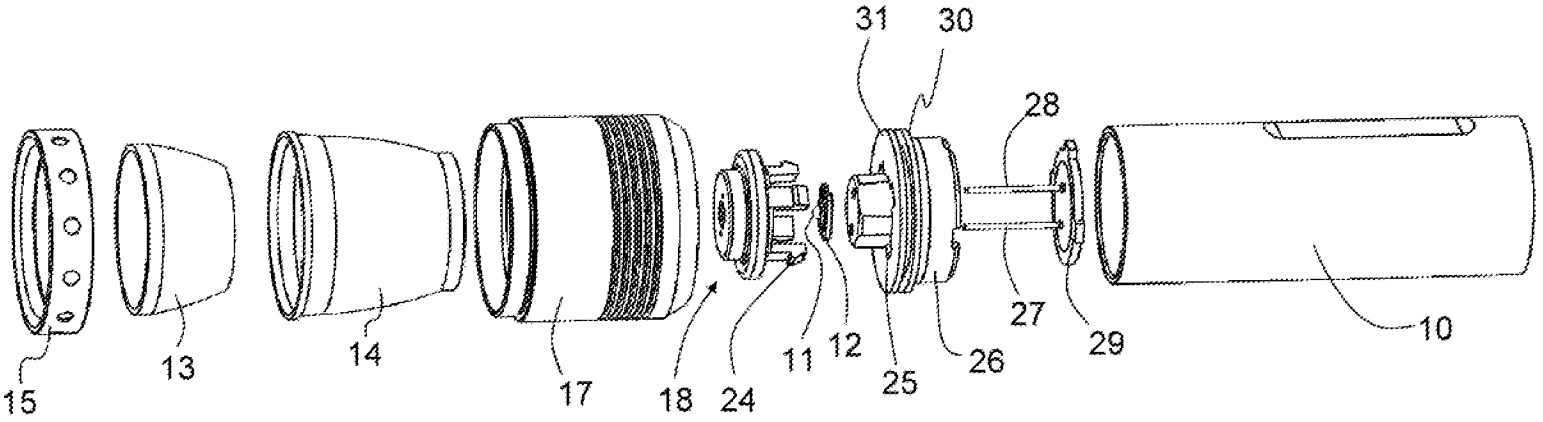
FIG. 1 a torch according to the present invention in an exploded representation, FIG. 2 a sectional view through the lamp head of a torch, FIG. 3 a sectional view through a membrane, FIG. 4 another torch according to the invention according to an exploded representation, FIG. 5 a sectional view through the head of the lamp according to FIG. 4 and FIG. 6 a sectional view through a differently configured membrane.
Figure 2:
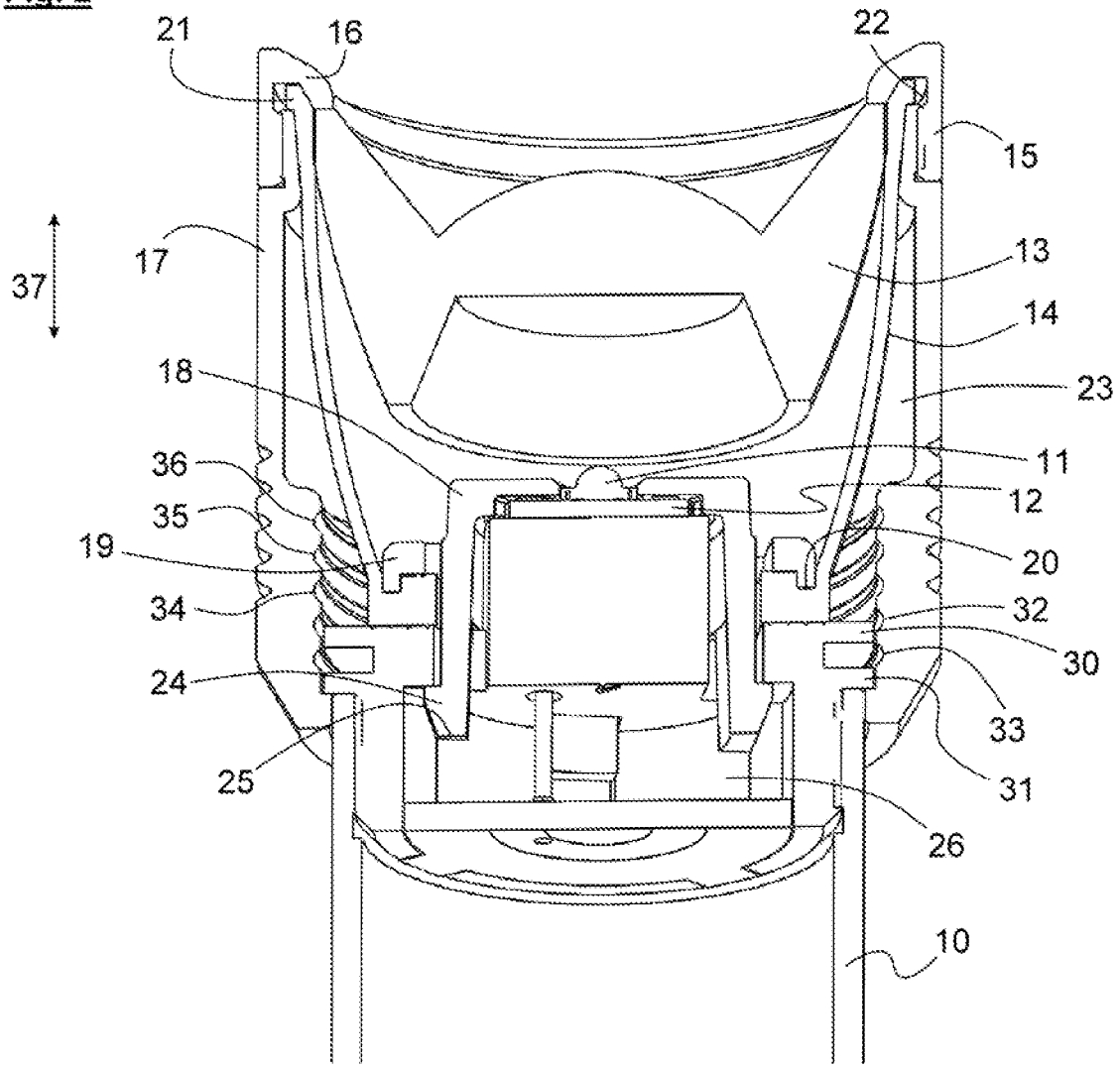
Figure 3:
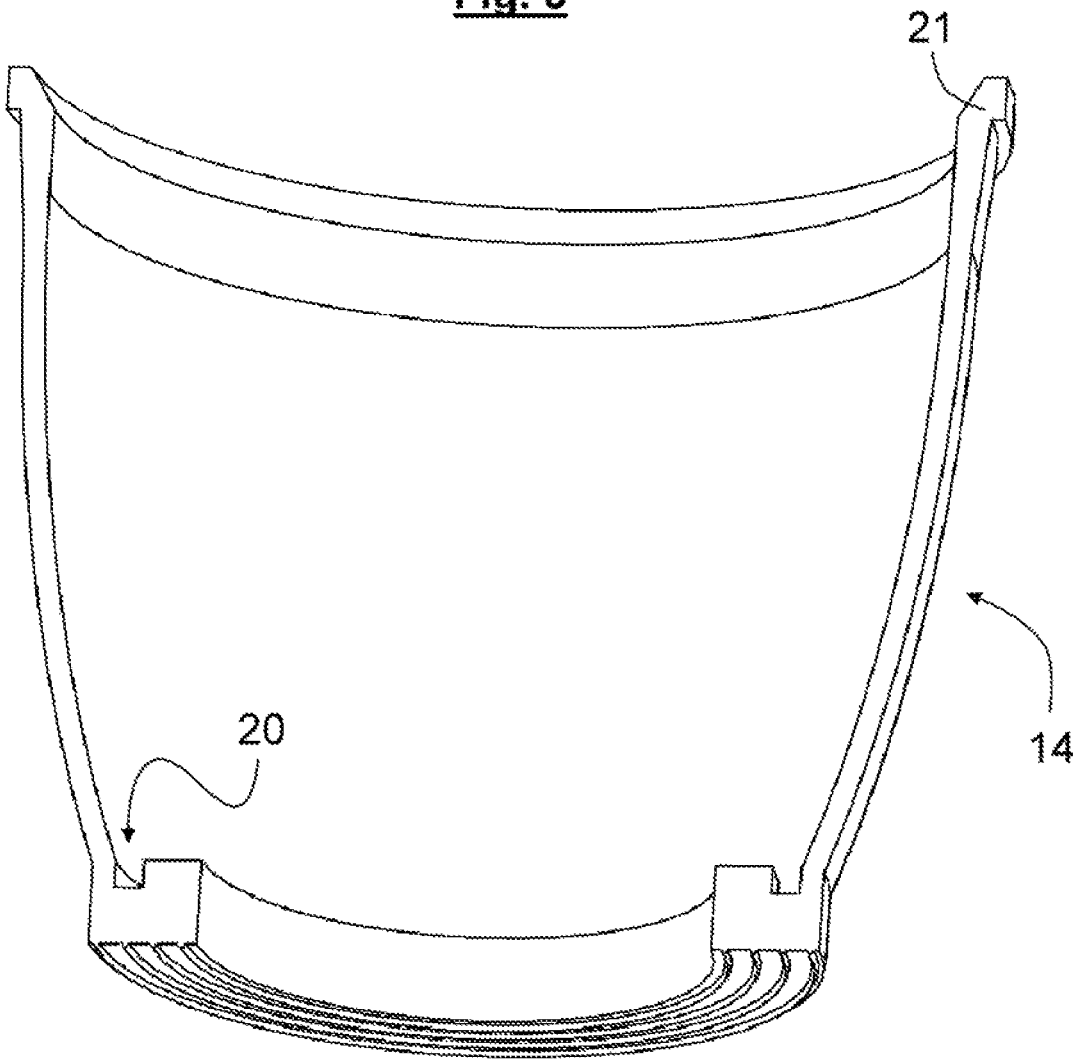

Battery-operated torches are known in principle, so that the arrangement of the batteries or battery, the switch for turning the torch on and off and the possible designs of an optical attachment, consisting of one or more lenses, are not described in greater detail. The different parts in a lamp housing 10, which is formed cylindrically in the present case, are depicted in detail in FIG. 1. The LED 11, which is arranged on a circuit board 12, forms together with the optical attachment 13 the substantial parts required for the illumination and the light cone formation. By displacing the optical attachment 13 with respect to the LED 11, the light cone can be varied, as is basically known according to the prior art. A membrane 14, which is depicted in detail in FIG. 3, is provided for dust-tight and waterproof shielding. The front closure is formed by the ring 15, which, as is recognized better from FIG. 2, has a circumferential inner collar 16 that acts at the same time as a stop for the optical attachment 14. The lamp head 17 is formed by a sheath-like element, over the front end of which said ring 15 is pushed and there creates a friction-type connection. A cover element 18 with an opening for leading the LED 11 through adjoins the upper side of the circuit board. The cover element 18 has a hook-shaped nose 19 as a circumferential part, which rests in a positive-locking manner in a groove 20 of the membrane 14. At its opposite end, the membrane has a collar 21, which engages in a groove 22 of the ring 15. As recognized in detail from FIG. 2, the membrane 14 is fixed in the lamp head housing 17 at the front edge and in the rear region via the positive connection 19, 20. The membrane 14 is elastic and preferably has a thickness of 0.6 mm. When the optical attachment is displaced away from the LED 11, the membrane is stretched, while when led back in the direction of the LED 11 it is slightly compressed. In each case the interior space 23 between the LED and the optical attachment is enclosed in a water- and liquid-proof manner by the membrane 14.

The cover element 18 has furthermore snap-in hooks 24 at its rear end 4, which engage in appropriately corresponding recesses 25 of a holder 26. The holder 26 has two holes through which the pins 27 and 28 can be inserted as a voltage supply. These pins are fixed to the circuit board 12 via clamping elements. The pins themselves protrude from a base plate 29, which is supported in a twist-proof manner in the lamp housing 10. The support element is formed overall by the parts 18, 26 and 29.

On its outer sheath the holder 26 has two protruding circumferential ribs 30, 31, which engage detachably in grooves 32, 33, 34, 35 or 36 on the internal edge of the housing, namely the lamp head 17. These grooves 32, 33, 34, 35 and 36 act in conjunction with the ribs 30, 31 as locking profiles, whereby the lamp head can be pushed back and forth along the longitudinal axis in the direction of the double arrow 37, wherein the lamp head takes the optical attachment 13 with it, whereas the LED together with the support element remain fixed in a stationary manner in relation to the housing 10. The grooves 32 to 36 are arranged equidistantly and form respective locking options of the lamp head.

Figure 4:
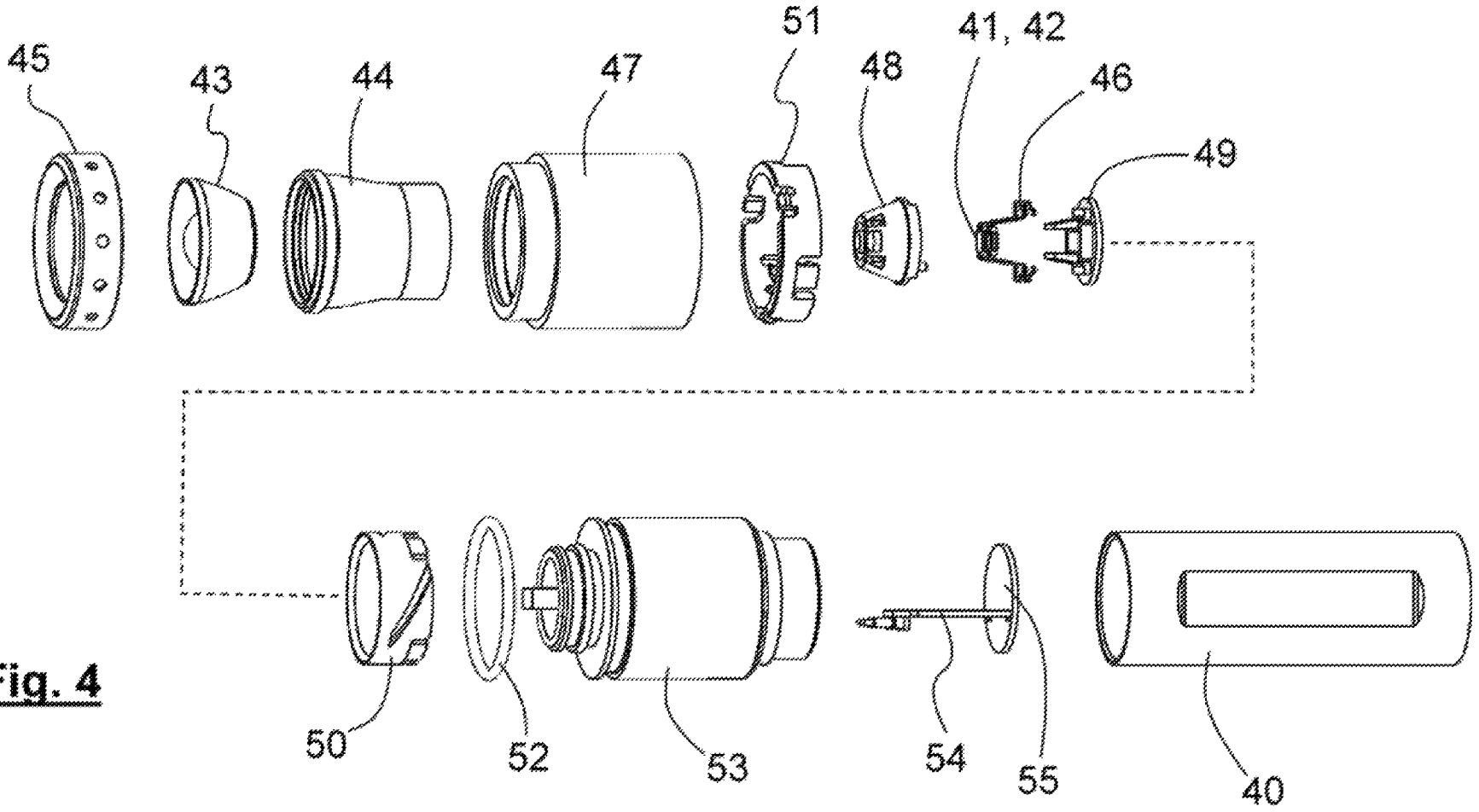
Figure 5:
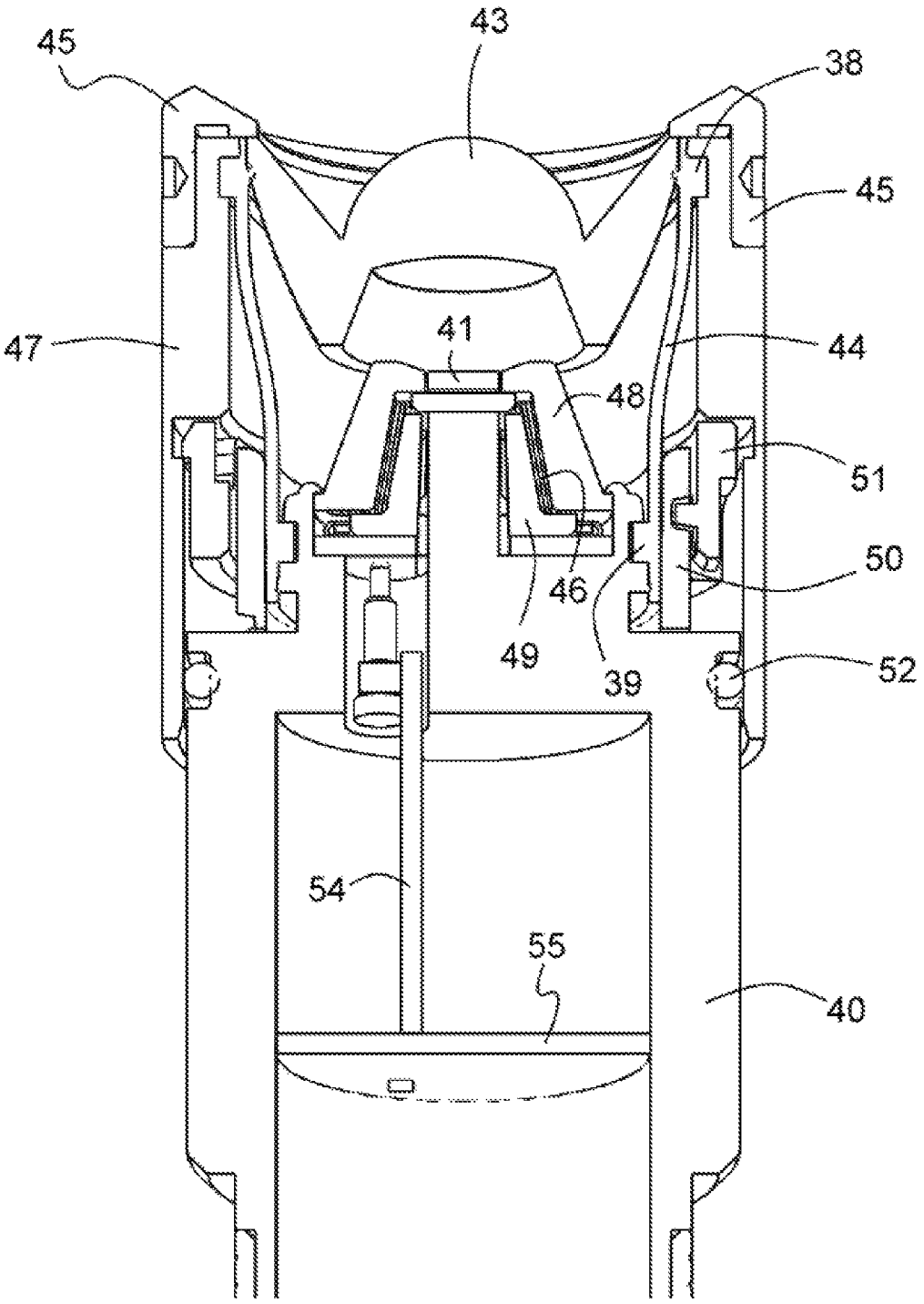
Figure 6:
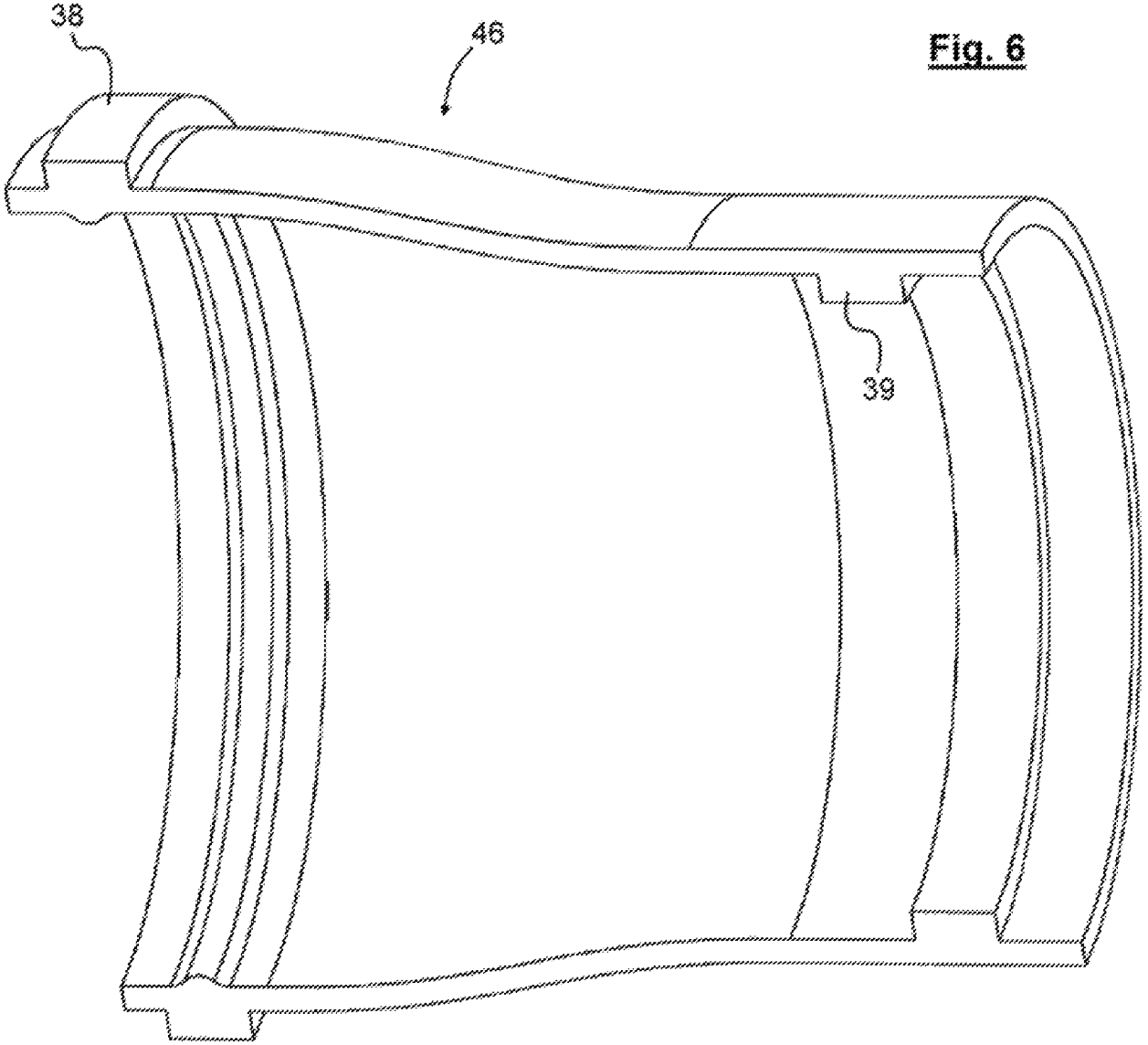

In FIGS. 4 to 6 a differently configured torch design has been chosen, in which the lamp head is not moved by means of a linear advance relative to the housing, but the lamp head is arranged rotatably in relation to the lamp housing, wherein a translatory movement of the lamp head 47 and thus a change in the distance of the optical attachment 43 relative to the LED 41 can be realized at the same time via the rotation. In FIGS. 4 and 5 the lamp housing 40 and the lamp head 47 are connected rotatably to one another. On the basis of the selected design of the guide part 50 and the carriage 51, the lamp head 47 is moved when the lamp head is rotated together with the optical attachment 43 so that the spacing of the optical attachment 43 from the LED 41, which is arranged on a circuit board 42, is reduced. In the present exemplary embodiment, an insulator 49 is required, which prevents a short circuit on account of the selected spring contacts 46. The parts 41, 42 and 47 are covered by a cover 48 for the lamp head aperture, which is determined by the screwed-on ring 45. In the present case also and as can be gathered in a sectional representation in FIG. 6, a membrane 44 is used as a seal, which closes the space between the LED and the optical attachment in a dust-tight and waterproof manner. This membrane 44 has an outer rib 38, which engages in a corresponding groove of the lamp head. At the opposite end the membrane 44 has an annular rib 39, which is fixed in a corresponding groove of the holder 53.

The membrane 44 is designed as a "rotation bellows" in which, however, acute-angled separating lines such as are known in rotation folding bellows have been eliminated to avoid excessive wear. To counteract the reset torque of the membrane 44 following corresponding rotation, an O-ring 52 is used in addition. The carriage 51 is attached by means of snap-in hooks in the lamp head, so that this carriage can move the entire lamp head in the guide part, which preferably has three guide grooves for guiding the carriage.

The invention claimed is:

1. A torch with a housing, in which at least one LED attached to a support element and an optical attachment are arranged, which are displaceable relative to one another for focusing the light cone radiated, characterized in that a seal comprising a membrane closes the space between the LED and the optical attachment in a dust-tight and waterproof manner, wherein the seal has at an upper edge a collar or a rib, wherein the collar or the rib is clamped between the optical attachment and the housing in a groove incorporated on an inner wall of the housing and at least one of: (i) a lower edge of the seal is connected to an annular body, the surface of which facing an inside of the seal is a groove, which together with a hook-shaped nose of the support element forms a positive connection, or (ii) the seal has an inner jacket in the lower region with an annular rib, the inner jacket engaging a groove of the support element.

2. The torch according to claim 1, characterized in that the seal comprises an elastic material, comprising at least one of silicone rubber or natural rubber.

3. The torch according to claim 1, characterized in that the seal has a thickness of 0.5 mm to 0.7 mm.

4. The torch according to claim 1, characterized in that the collar, the seal and the annular body form an integral part.

5. The torch according to claim 4, characterized in that the support element is constructed in multiple parts and comprises the following parts:

a circuit board supporting the LED with voltage connections, two clamping elements for fixing the circuit board on pins that are used for the voltage supply, a base plate fixed in a non-rotating manner in the lamp housing from which the two clamping elements project, a holder with holes to lead the pins through and a front cover element, which comprises a front opening for the LED and snap-in hooks, which protrude to the rear and engage in corresponding recesses of the holder, forming a snap connection.

6. The torch according to claim 5, characterized in that the support element has on its outer jacket at least two protruding, circular ribs, which engage detachably in grooves on the inner jacket of the housing.

7. The torch according to claim 6, characterized in that several circumferential grooves are provided spaced from one another on the inner jacket of the housing, which serve as locking profiles for the ribs on the outer jacket of the support for fixing different positions of the LED support along the longitudinal axis in relation to the optical attachment.

8. The torch according to claim 7, characterized in that the optical attachment is arranged and fastened in a longitudinally displaceable lamp head, whereas the support element of the LED is arranged stationary in the lamp housing.

9. The torch according to claim 4, characterized in that the lamp head is fixedly connected to the optical attachment and that the lamp head is longitudinally displaceable by means of a helical guide with respect to the lamp housing by relative rotation, the torch further comprising an O-ring seal between the lamp head and lamp housing.

10. The torch according to claim 1, characterized in that the support element is constructed in multiple parts and comprises the following parts:

a circuit board supporting the LED with voltage connections, two clamping elements for fixing the circuit board on pins that are used for the voltage supply, a base plate fixed in a non-rotating manner in the lamp housing from which the two clamping elements project, a holder with holes to lead the pins through, and a front cover element, which comprises a front opening for the LED and snap-in hooks, which protrude to the rear and engage in corresponding recesses of the holder forming a snap connection.

11. The torch according to claim 10, characterized in that the optical attachment is arranged and fastened in a longitudinally displaceable lamp head, whereas the support element of the LED is arranged stationary in the lamp housing.

12. The torch according to claim 1, characterized in that the support element has on its outer jacket at least two protruding circular ribs which engage detachably in grooves on the inner jacket of the housing.

13. The torch according to claim 12, characterized in that several circumferential grooves are provided spaced from one another on the inner jacket of the housing, which serve as locking profiles for the ribs on the outer jacket of the support for fixing different positions of the LED support along the longitudinal axis in relation to the optical attachment.

14. The torch according to claim 1, characterized in that the optical attachment is arranged and fastened in a longitudinally displaceable lamp head, whereas the support element of the LED is arranged stationary in the lamp housing.

15. The torch according to claim 14, characterized in that the lamp head is fixedly connected to the optical attachment and that the lamp head is longitudinally displaceable by means of a helical guide with respect to the lamp housing by relative rotation, the torch further comprising an O-ring seal between the lamp head and lamp housing.

16. The torch according to claim 1, characterized in that the support element is constructed in multiple parts and comprises the following parts:

a circuit board supporting the LED with voltage connections, two clamping elements for fixing the circuit board on pins that are used for the voltage supply, a base plate fixed in a non-rotating manner in the lamp housing from which the two clamping elements project, a holder with holes to lead the pins through and a front cover element, which comprises a front opening for the LED and snap-in hooks, which protrude to the rear and engage in corresponding recesses of the holder, forming a snap connection.

17. The torch according to claim 1, characterized in that the lamp head is fixedly connected to the optical attachment and that the lamp head is longitudinally displaceable by means of a helical guide with respect to the lamp housing by relative rotation, the torch further comprising an O-ring seal between the lamp head and lamp housing.

18. A torch with a housing, in which at least one LED attached to a support element and an optical attachment are arranged, which are displaceable relative to one another for focusing the light cone radiated, characterized in that a seal comprising a membrane closes the space between the LED and the optical attachment in a dust-tight and waterproof manner, wherein the support element comprises:

a circuit board supporting the LED with voltage connections, two or more clamping elements for fixing the circuit board on pins that are used for the voltage supply, a base plate fixed in a non-rotating manner in the lamp housing from which the two clamping elements project, a holder with holes to lead the pins through and a front cover element, which comprises a front opening for the LED and snap-in hooks, which protrude to the rear and engage in corresponding recesses of the holder, forming a snap connection.

* * * * *